US006305342B1

(12) United States Patent
Narita et al.

(10) Patent No.: US 6,305,342 B1
(45) Date of Patent: Oct. 23, 2001

(54) LUBRICATION SYSTEM FOR INTERNAL COMBUSTION ENGINE

(75) Inventors: Satoru Narita; Takashi Shichinohe, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/654,343

(22) Filed: Sep. 1, 2000

(30) Foreign Application Priority Data

Sep. 3, 1999 (JP) ..... 11-250058

(51) Int. Cl.[7] ..... F02F 7/00
(52) U.S. Cl. ..... 123/196 R; 123/195 AC
(58) Field of Search ..... 123/196 R, 196 AB, 123/196 CP, 195 R, 195 AC, 195 C; 184/106

(56) References Cited

U.S. PATENT DOCUMENTS

| | | | | |
|---|---|---|---|---|
| 4,681,189 | * | 7/1987 | Krisiloff | 184/6.13 |
| 4,836,156 | * | 6/1989 | Inagaki et al. | 123/90.31 |
| 4,993,374 | * | 2/1991 | Okui | 123/90.31 |
| 5,099,945 | * | 3/1992 | Okui et al. | 180/297 |
| 5,184,582 | * | 2/1993 | Okui et al. | 123/90.31 |
| 5,257,624 | * | 11/1993 | Okui et al. | 180/297 |
| 5,307,865 | * | 5/1994 | Inagaki et al. | 165/41 |
| 5,509,381 | * | 4/1996 | Fisher | 123/41.31 |
| 5,588,405 | * | 12/1996 | Sawa et al. | 123/90.33 |
| 5,636,608 | * | 6/1997 | Shichinohe et al. | 123/197.1 |
| 6,167,978 | * | 1/2001 | Smietanski | 180/69.4 |
| 6,176,211 | * | 1/2001 | Tanaka et al. | 123/90.61 |
| 6,230,680 | * | 5/2001 | Pirone | 123/196 R |

FOREIGN PATENT DOCUMENTS

| | | | | |
|---|---|---|---|---|
| 4431133-A1 | * | 3/1996 | (DE) | F01M/5/00 |
| 62-23514 | * | 1/1987 | (JP) | F01M/1/02 |
| 586829 | | 4/1993 | (JP) . | |
| 8135419 | | 5/1996 | (JP) . | |

* cited by examiner

*Primary Examiner*—Noah P. Kamen
*Assistant Examiner*—Hai Huynh
(74) *Attorney, Agent, or Firm*—Birch, Stewart, Kolasch & Birch, LLP

(57) ABSTRACT

Looking from a front toward a rear of a vehicle, a crankcase has a cross sectional shape which gets narrower towards its bottom. The crankcase includes a crankshaft which extends parallel to a direction of travel for the vehicle. A main shaft, a counter shaft and an output shaft of a transmission are arranged in a transmission chamber on one side of the crankshaft. An oil tank is provided on the same side of the crankshaft and outwardly of the transmission chamber. The oil tank is separated from the transmission chamber by a partitioning wall. The oil tank has a substantially crescent shape, with the lower end extending beneath the output shaft. An intake port of a feed pump is provided in the lowest part of the oil tank. An oil inlet for adding oil to the oil tank is provided just above the oil tank. An overflow hole to the transmission chamber is provided in the partitioning wall. The feed pump is provided on an opposite side of the crankshaft inside the crankcase. A scavenge pump, which sucks from an oil sump at the lowest section of the crankcase and returns oil to the oil tank, is also provided on the opposite side of the is crankshaft and inside the crankcase. A drain hole communicates with the oil tank and with the transmission chamber. The drain hole is provided in a lower part of the crankcase and is closed by a drain bolt.

18 Claims, 10 Drawing Sheets

LUBRICATION SYSTEM FOR INTERNAL COMBUSTION ENGINE

BACKGROUND OF THE INVENTION

1. Field of the Invention

The present invention relates to a lubrication system for an internal combustion engine, and more particularly to a dry sump type lubrication structure.

2. Description of the Relevant Art

In a dry sump type lubrication structure, oil that has accumulated in a sump is sucked up by a scavenge pump and sent to an oil tank through an oil cooler, and oil in an oil tank is supplied to parts of the engine by a feed pump. This means that there is piping respectively between the oil cooler, the scavenge pump and the oil tank. As an example, Japanese Patent Laid-Open No. Hei-5-86829 discloses hoses, viewed from the side, that are fitted so as to run from the front over a cylinder and to the rear. This is achieved by plumbing a sending side hose from a rear upper surface of a transmission chamber to a catch tank above the cylinder, and plumbing a return side hose from the catch tank past the front of the cylinder to an oil tank below a crankcase, based on blow-by gas. Also, piping is made to intersect, and is gathered together at either the left or right side of the vehicle.

Also, Japanese Patent Laid-Open No. Hei-8-135419 discloses plumbing a sending side hose for sending oil sucked up by a scavenge pump from an oil pan provided in the central lower part of a crankcase from an upper surface of the crankcase behind the cylinder, above the cylinder and to an oil cooler in front of the cylinder, and, using the same route, piping a return side hose to an upper surface of a transmission.

In accordance with the background art, it is necessary to plumb a sending side hose and a return side hose. Such hoses are expensive and heavy. Further, the hoses must be ran over a long path length which increases the weight and costs of the vehicle. Accordingly, there is a need in the art for a lubrication structure which will shorten these oil hoses.

SUMMARY OF THE INVENTION

It is an object of the present invention to address one or more of the drawbacks associated with the background art.

These and other objects are accomplished by an internal combustion engine comprising: a crankcase; an oil tank arranged inside and on one side of said crankcase; and an oil pump arranged inside and on another side of said crankcase opposite to said one side of said crankcase, said oil pump including a feed pump and a scavenge pump, said feed pump for supplying lubricating oil inside said oil tank to respective components of the internal combustion engine, and said scavenge pump for returning lubricating oil that has accumulated in a bottom of said crankcase to said oil tank.

Further, these and other objects are accomplished by an internal combustion engine comprising: a crankcase; a crankshaft disposed in said crankcase; an oil tank arranged inside said crankcase and on one side of said crankshaft; an oil pump arranged inside said crankcase and on another side of said crankshaft opposite to said one side of said crankshaft, said oil pump including a feed pump and a scavenge pump, said feed pump for supplying lubricating oil inside said oil tank to respective components of the internal combustion engine, and said scavenge pump for returning lubricating oil that has accumulated in a bottom of said crankcase to said oil tank; and an oil cooler, wherein oil pumped by aid scavenge pump is passed through said oil cooler prior to being returned to said oil tank.

Moreover, these and other objects are accomplished by a combination comprising: a vehicle; and an internal combustion engine including: a crankcase; a crankshaft disposed in said crankcase, with said crankshaft extending in a direction parallel to a direction of travel of said vehicle; an oil tank arranged inside said crankcase and on one side of said crankshaft; an oil pump arranged inside said crankcase and on another side of said crankshaft opposite to said one side of said crankshaft, said oil pump including a feed pump and a scavenge pump, said feed pump for supplying lubricating oil inside said oil tank to respective components of the internal combustion engine, and said scavenge pump for returning lubricating oil that has accumulated in a bottom of said crankcase to said oil tank; and an oil cooler, wherein oil pumped by said scavenge pump is passed through said oil cooler prior to being returned to said oil tank.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 2:
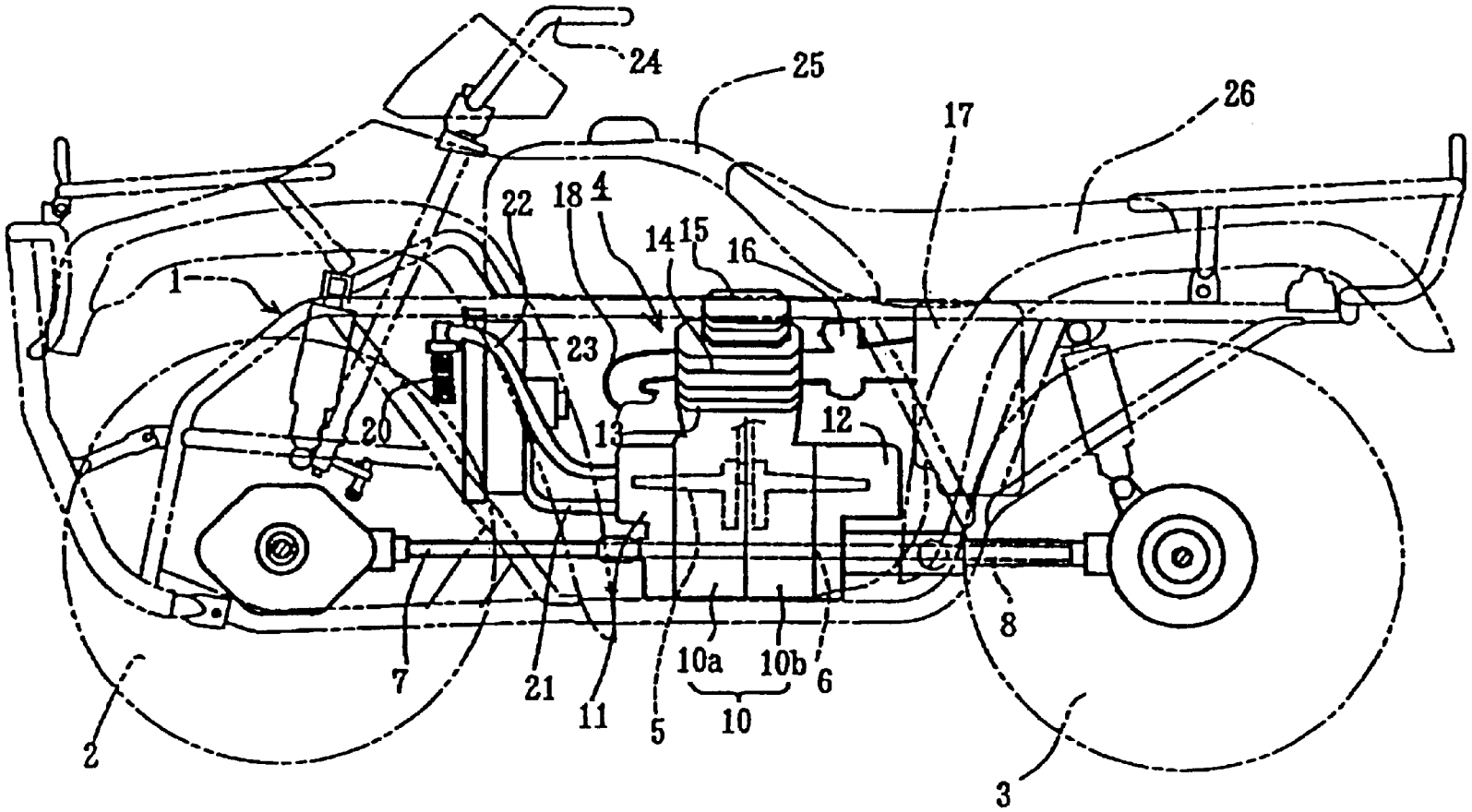
FIG. 2 is a side view of an ATV including a power unit, in accordance with the present invention.

A description will now be given of an embodiment of the present invention applied to a four-wheeled buggy or all-terrain vehicle (ATV). As illustrated in FIG. 2, the four-wheeled buggy is provided with a pair of left and right front wheels 2 and a pair of left and right rear wheels 3, taken in a longitudinal direction of the vehicle frame 1. A power unit 4, comprising an engine and a transmission 44, is supported in a central portion of the vehicle frame 1. The power unit 4 has a transverse structure, wherein a crankshaft 5 extends in the longitudinal direction of the vehicle.

The four-wheeled buggy is a four-wheel drive type. An output shaft 6 is provided parallel to the crankshaft 5 and below the power unit 4. The front wheels 2 are driven via a front wheel propeller shaft 7 connected to the output shaft 6. The rear wheels 3 are driven via a rear wheel propeller shaft 8 connected to the output shaft 6.

A front side of a crankcase 10, constituting the power unit 4, is covered by a front case cover 11. A rear side is covered by a rear case cover 12. These case covers 11, 12 house the power unit 4.

The crankcase 10 is also longitudinally partitioned into a front case 10*a* and a rear case 10*b*. A cylinder block 13, a cylinder head 14 and a cylinder head cover 15 are attached to an upper part of the crankcase 10. A carburetor 16 is connected to an intake port of the cylinder head 14. An air cleaner 17 is connected to a rear side of the carburetor 16. An exhaust pipe 18 is connected to an exhaust port of the cylinder head 14.

An oil cooler 20 is arranged in front of the power unit 4 with a cooling surface facing toward the traveling direction of the ATV. The oil cooler 20 receives oil from the crankcase 10 via a feed side hose 21, and returns oil to the crankcase via a return side hose 22. An oil pump 62, in the crankcase 10, facilitates the circulation of oil. The ATV also includes a cooling fan 23, a handlebar 24, a fuel tank 25, and a saddle type seat 26.

Figure 3:
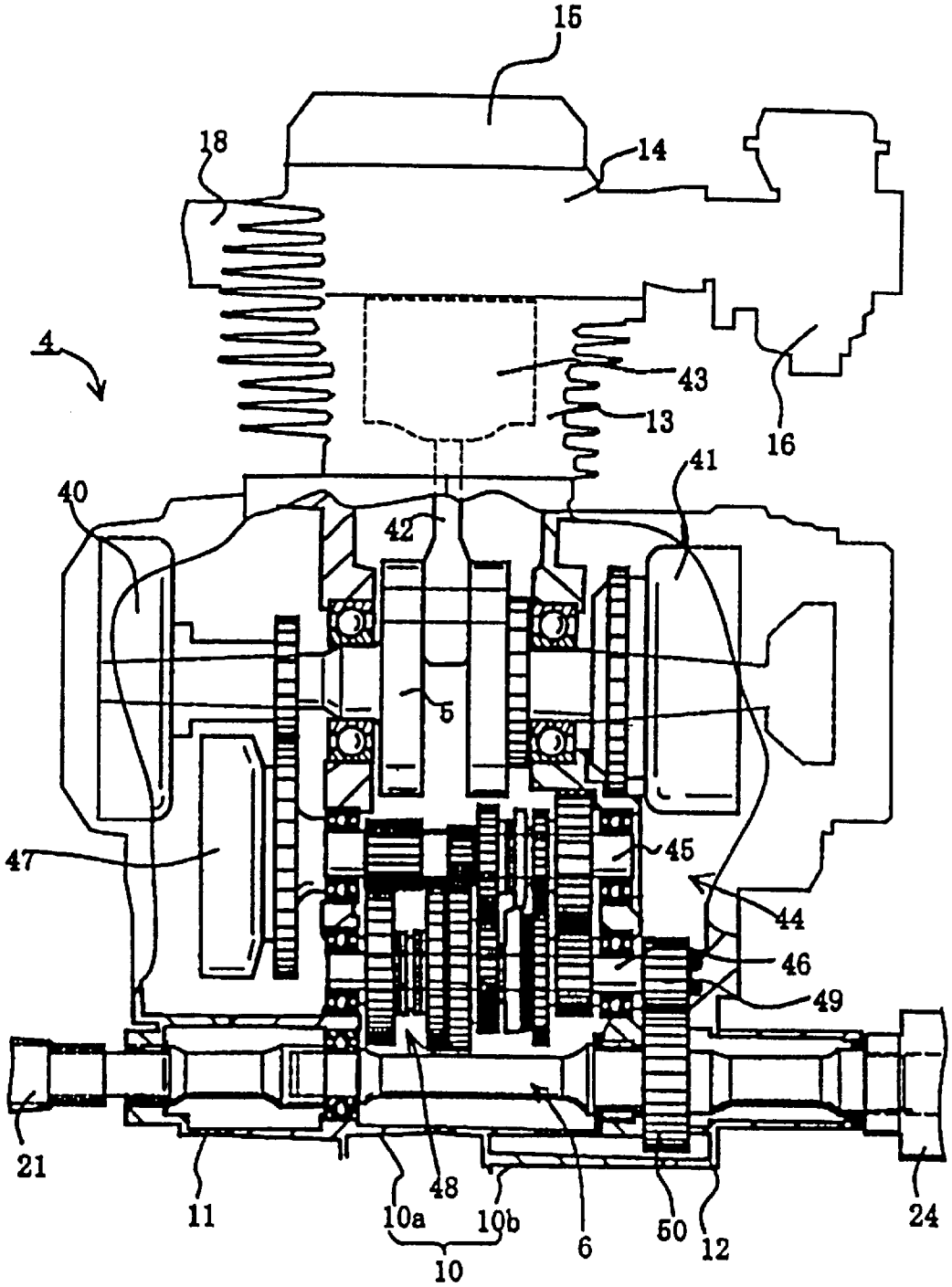
FIG. 3 is a partial cross sectional view of the power unit of FIG. 2.

FIG. 3 is a cross sectional view of a transmission mechanism portion of the power unit 4. As set forth above, the front side of the crankcase 10 is covered by a front case cover 11, while the rear side is covered by the rear case cover 12. The crankcase 10, and the front and rear covers 11, 12 constitute the power unit case. Also, the cylinder block 13, the cylinder head 14 and the cylinder head cover 15 are attached to an upper part of the crankcase 10.

The crankcase 10 is made up of two longitudinally divided sections, namely the front case 10*a* and the rear case 10*b*. The crankshaft 5 is fitted between the front case 10*a* and the rear case 10*b*. A starting clutch 40, such as a well-known centrifugal clutch mechanism, is provided on one end of the crankshaft 5. An AC generator (ACG) 41 is provided on the other end of the crankshaft 5. The cross sectional view of FIG. 3 also illustrates a connecting rod 42 and a piston 43.

The transmission 44 may be constructed as a well-known constant-mesh transmission. The transmission 44 includes a main shaft 45 and a counter shaft 46 arranged parallel to the crankshaft 5. A speed change clutch, or centrifugal clutch, 47 is provided on one end of the main shaft 45, The speed change clutch 47 selectively couples and disconnects a drive force of the crankshaft 5 to the main shaft 45. A plurality of constant mesh transmission gear trains 48 are provided between the main shaft 45 and the counter shaft 46. The gear trains 48 are used to selectively change a rotation speed at which the counter shaft 46 is driven by the main shaft 45. Rotation of the counter shaft 46 is output from a final drive gear 49, provided on one end of the counter shaft 46, to a final driven gear 50 on the output shaft 6.

Figure 1:
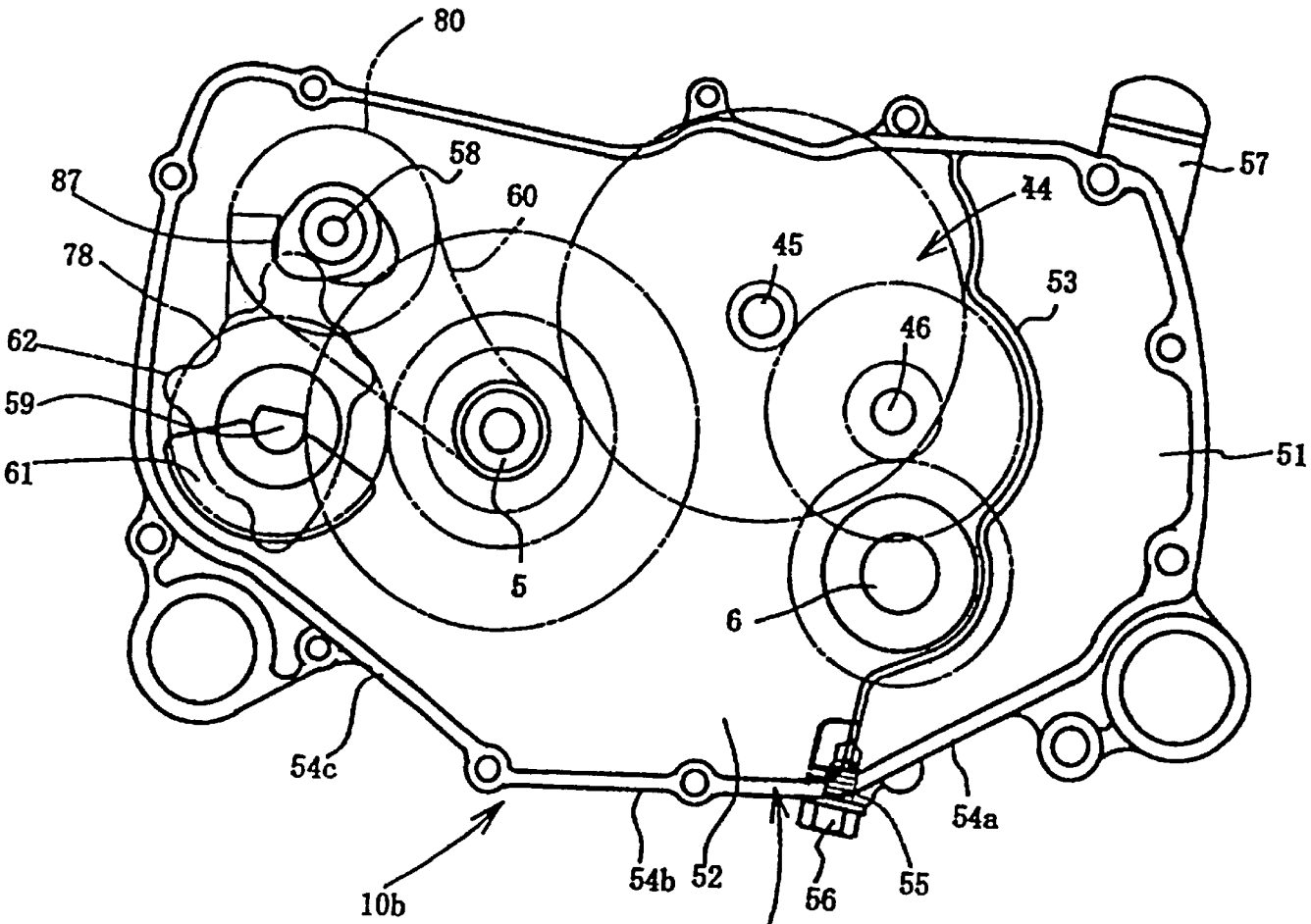
FIG. 1 is a front view illustrating an arrangement of respective shafts in a crankcase, in accordance with the present invention.

FIG. 1 is a schematic diagram illustrating the layout of each shaft in the rear case 10*b*. FIG. 1 depicts the parting plane of the rear case 10*b* and the front case 10*a*, seen from a front side of the vehicle. The transmission 44 is arranged on the right side of the crankshaft 5. An oil tank 51 is provided on an end of the transmission 44, to the right of the transmission 44. The oil tank 51 is formed between the front case cover 11 and the front case 10*a*, and between the front case 10*a* and the rear case 10*b*. The oil tank 51 is partitioned from a transmission chamber 52, housing the transmission 44, by a partitioning wall or bulkhead 53.

The bulkhead 53 starts from an upper end of the rear case 10*b*, extends along the right side of the transmission 44, and reaches to a bottom portion 54 of the rear case 10*b*. A lower end of the bulkhead 53 extends below the output shaft 6. The oil tank 51 is longer in the vertical direction, and as a result, the oil tank 51 is formed into a substantially crescent shape, when viewed from the front (as illustrated in FIG. 1).

Each of the front case 10*a* and the rear case 10*b* of the crankcase 10 has the same contour or outline shape, in the plane of FIG. 1. The bottom section 54 slopes towards the center, via a left sloping surface 54*c* on the left side and a right sloping surface 54*a* on the right side, becoming narrower towards the center, with a central portion being the lowest point. A lower end of the bulkhead 53 is connected to a connection point between the right sloping section 54*a* and a central section 54*b*, forming the bottom of the oil tank 51. The connection point of the three wall sections is punched out towards the bulkhead 53, so that a drain hole 55 communicates with both the oil tank 51 and the transmission chamber 52. A drain bolt 56 is fitted into this drain hole 55. An oil inlet 57 is provided in an upper part of the oil tank 51.

A cam shaft 58 and a balancer shaft 59 are arranged parallel with each other. The cam shaft 58 and the balancer shaft 59 are located on the left side of the crankshaft 5. In other words, the cam shaft 58 and the balancer shaft 59 are located on a side opposite to the transmission 44 relative to the crankshaft 5. The camshaft 58 is driven by the crankshaft 5, via a cam chain 60. The balancer shaft 59 is also driven by the crankshaft 5, so that a balancer 61, on the balancer shaft 59, rotates in synchronism with the crankshaft 5. The balancer shaft 59 is linked to the oil pump 62 at its front end, and drives the oil pump 62.

Figure 4:
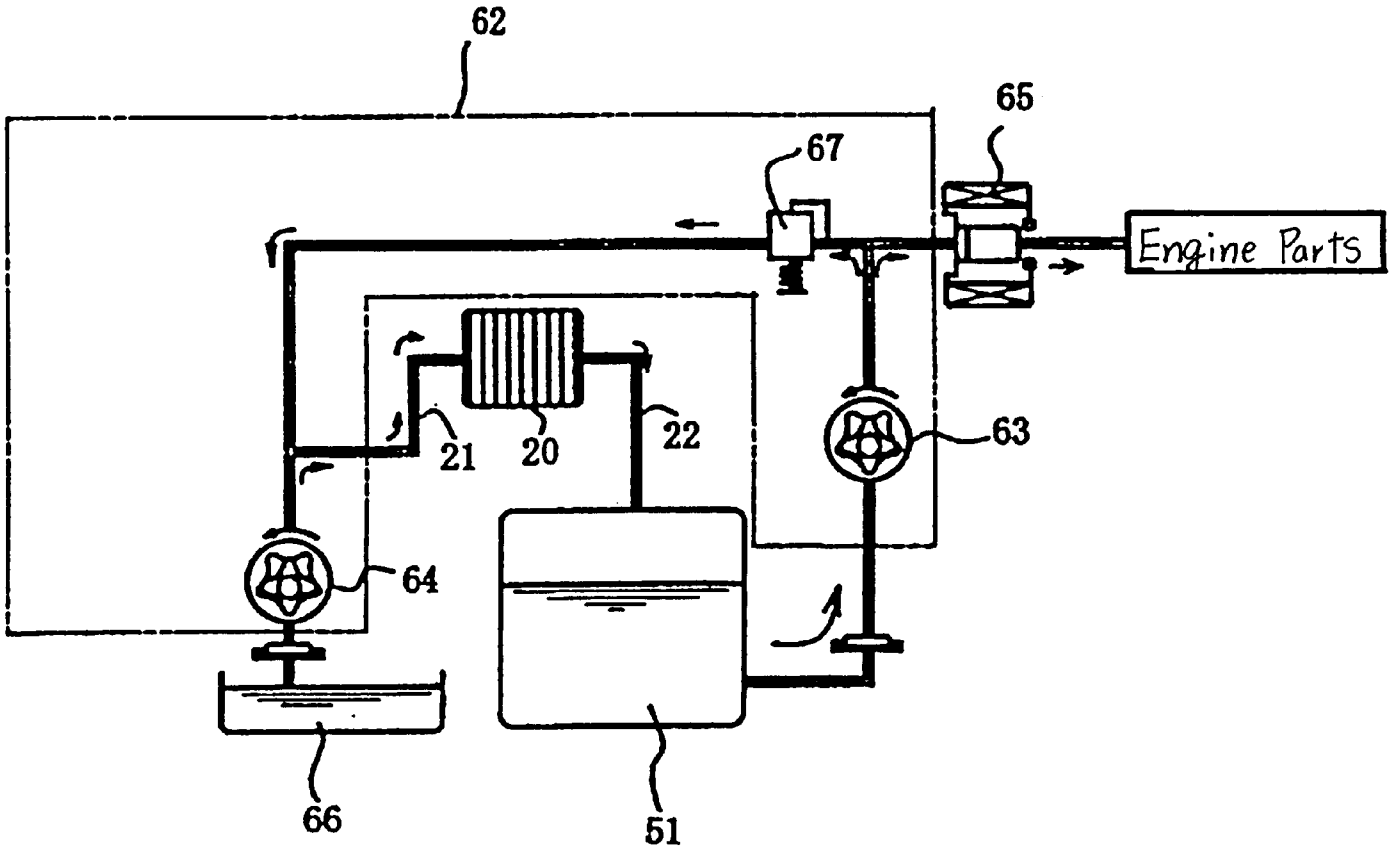
FIG. 4 is a diagram illustrating a flow of oil through a lubrication system, in accordance with the present invention.

Referring to FIG. 4, the oil pump 62 includes a feed pump 63 and a scavenge pump 64. The feed pump 63 and the scavenge pump 64 have respective rotors on the same drive shaft, and are preferably integrally formed. The feed pump 63 sucks oil from the oil tank 51 and supplies the oil, through an oil filter 65, to respective lubrication sections of the engine. The scavenge pump 64 draws oil from an oil sump 66, which is formed, for instance, at the central section 54*b* of the bottom section 54, sends the oil to the oil cooler 20. After the oil passes through the oil cooler 20, the oil is returned to the oil tank 51. A relief valve 67 is provided inside the discharge passageway of the feed pump 63. If the discharge pressure of the feed pump 63 exceeds a specified pressure, an escape is opened to the discharge passageway of the scavenge pump 64.

Figure 5:
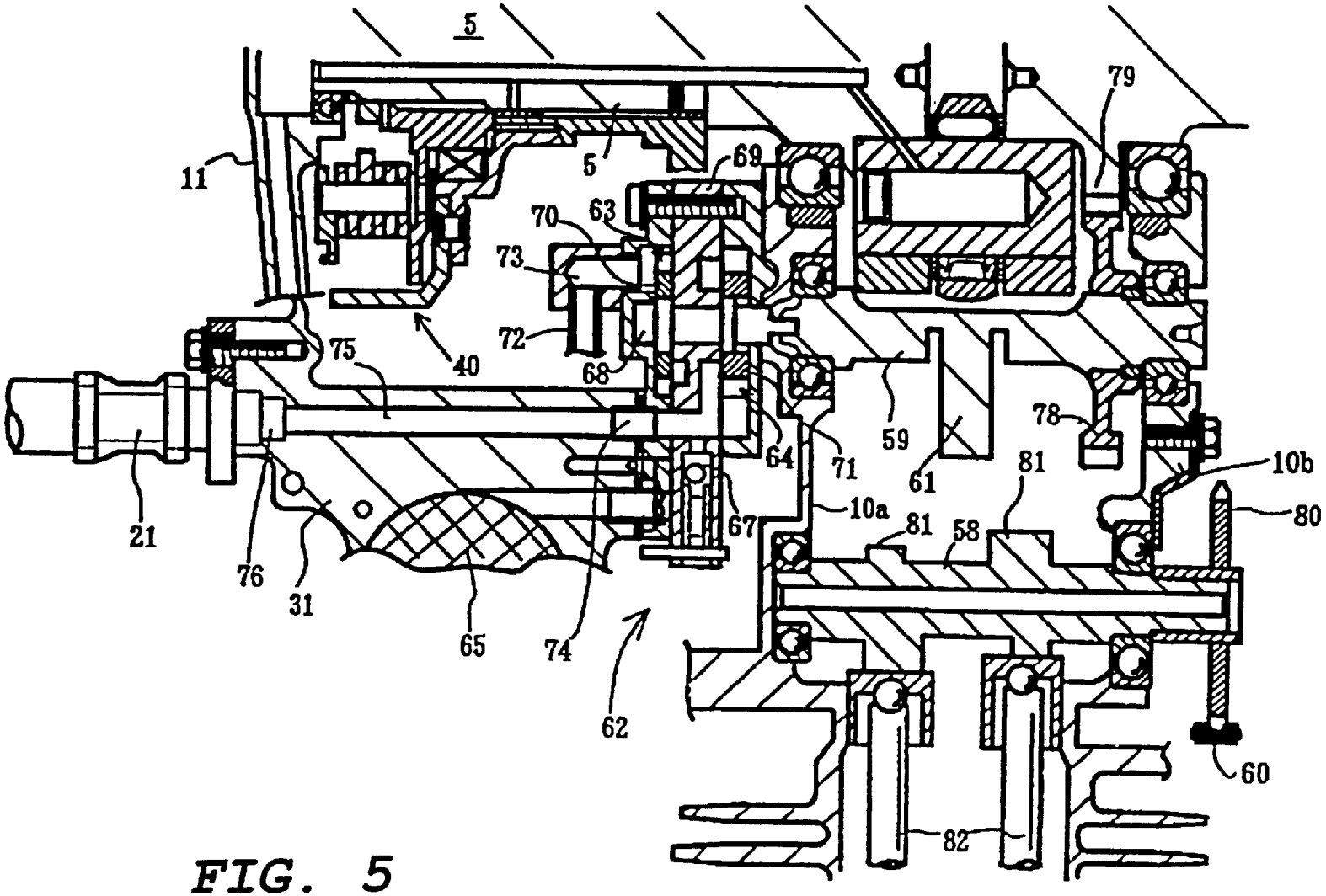
FIG. 5 is a cross sectional view illustrating an oil pump of the lubricating system.

FIG. 5 is a cross section drawing illustrating the oil pump 62. The feed pump 63 and the scavenge pump 64 are integrally formed with each other inside a common pump housing. A feed pump rotor 70 for the feed pump 63 and a scavenge pump rotor 71 for the scavenge pump 64 are arranged on a common drive shaft 68, while being disposed on opposite sides of a dividing or partition wall 69. The drive shaft 68 is arranged coaxially with the balancer shaft 69. The drive shaft 68 is arranged to the front of the front case 10*a*, while the balancer shaft 59 is arranged between the front case 10*a* and the rear case 10*b*. The drive shaft 68 and the balancer shaft 59 are connected and rotate integrally.

In FIG. 5, a feed pump pipe 72 for the feed pump 63 is connected to an inlet 73 of the feed pump 63. A scavenge pump discharge port 74 of the scavenge pump 64 leads to a discharge passageway 75 formed in the front case cover 11. One end of the feed side hose 21 is connected to an outlet 76 of the discharge passageway 75.

A balancer gear 78 is provided on the balancer shaft 59. The balancer gear 78 meshes with a balancer drive gear 79 formed on the crankshaft 5. A cam sprocket 80 is provided at one end of the cam shaft 58. The cam sprocket 80 is driven by a drive sprocket provided on the crankshaft 5, via the cam chain 60. A cam 81 on the cam shaft 58 drives a valve mechanism on the cylinder head 14 side, via a push rod 82.

Figure 6:
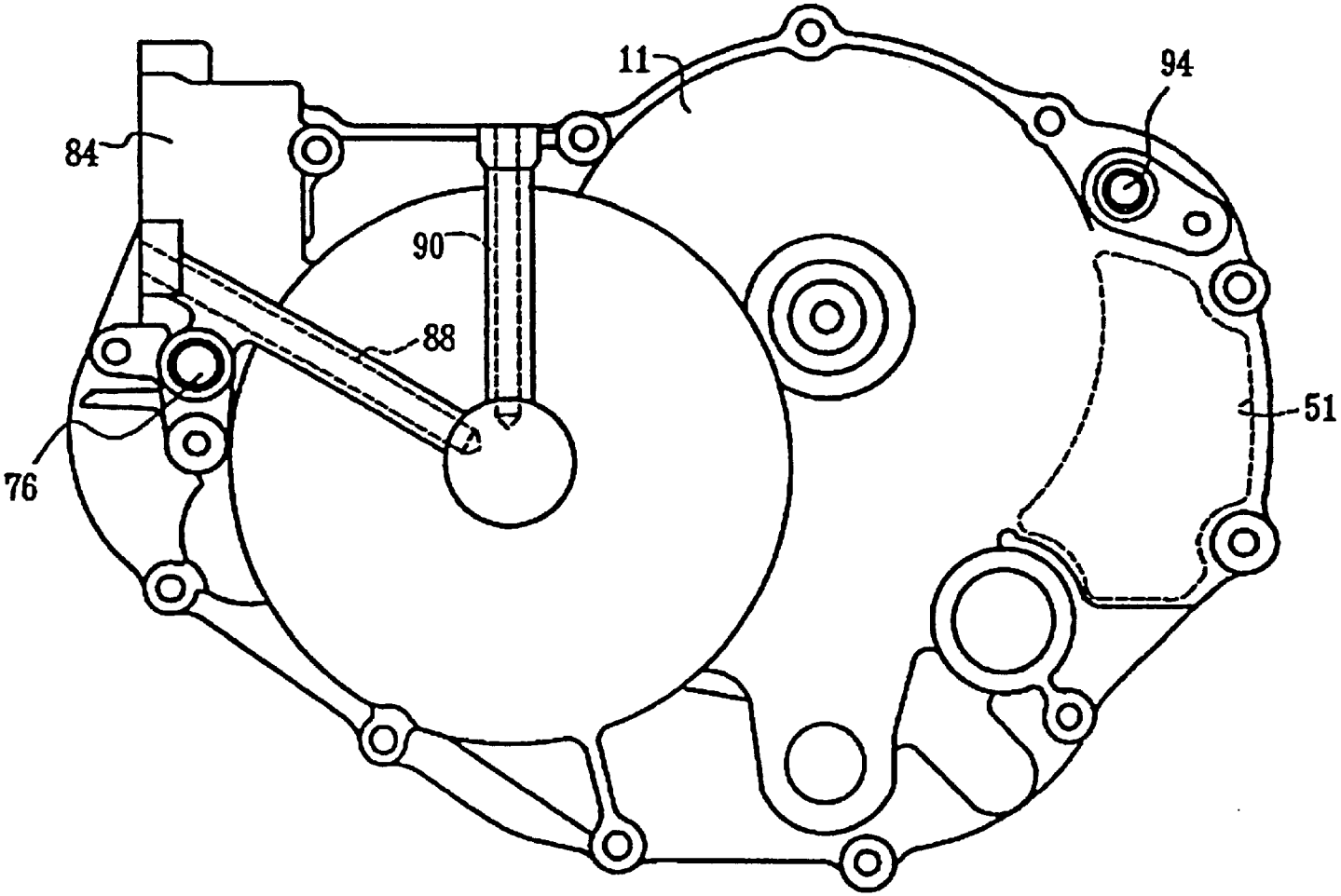
FIG. 6 is a front view illustrating a front case cover.
Figure 7:
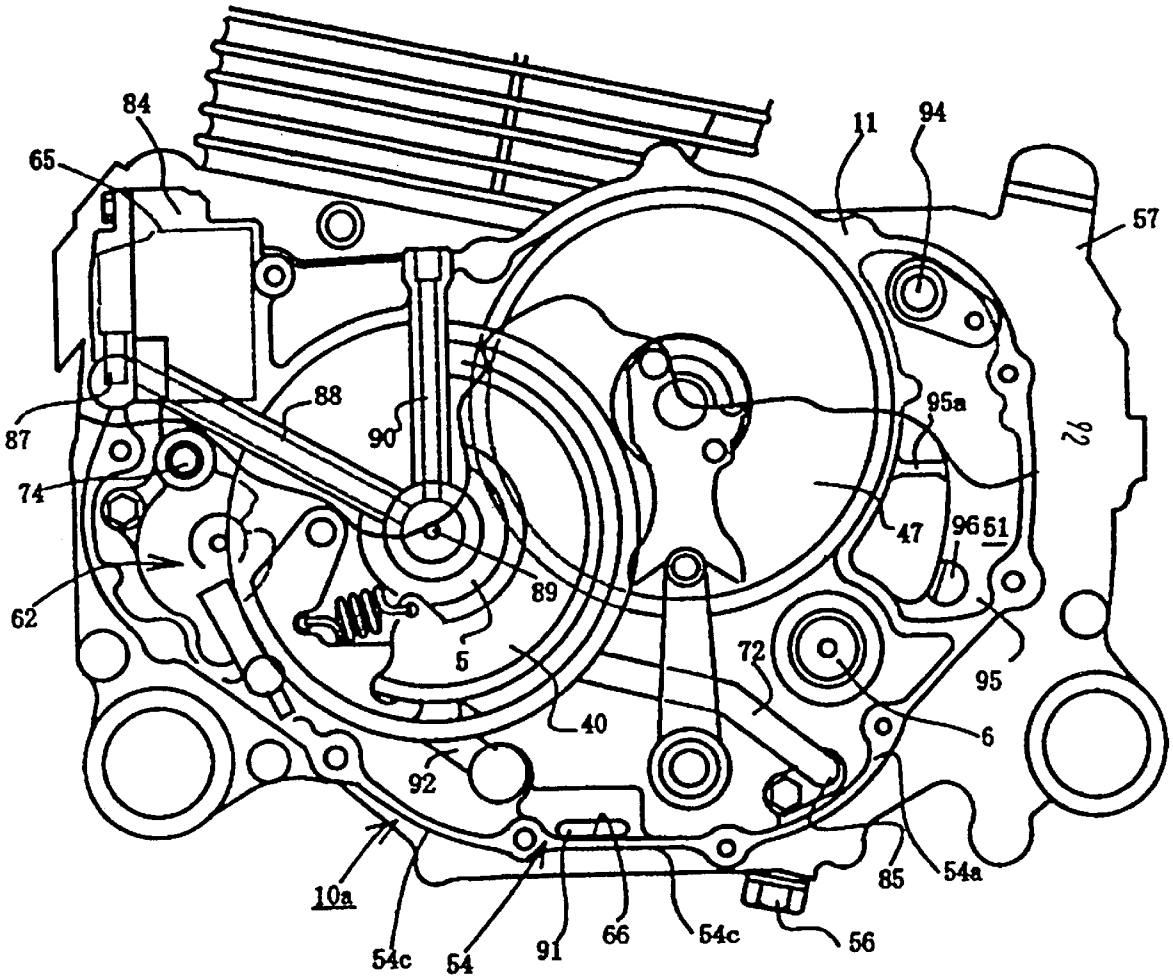
FIG. 7 is a front view of a front case of a crankcase.
Figure 8:
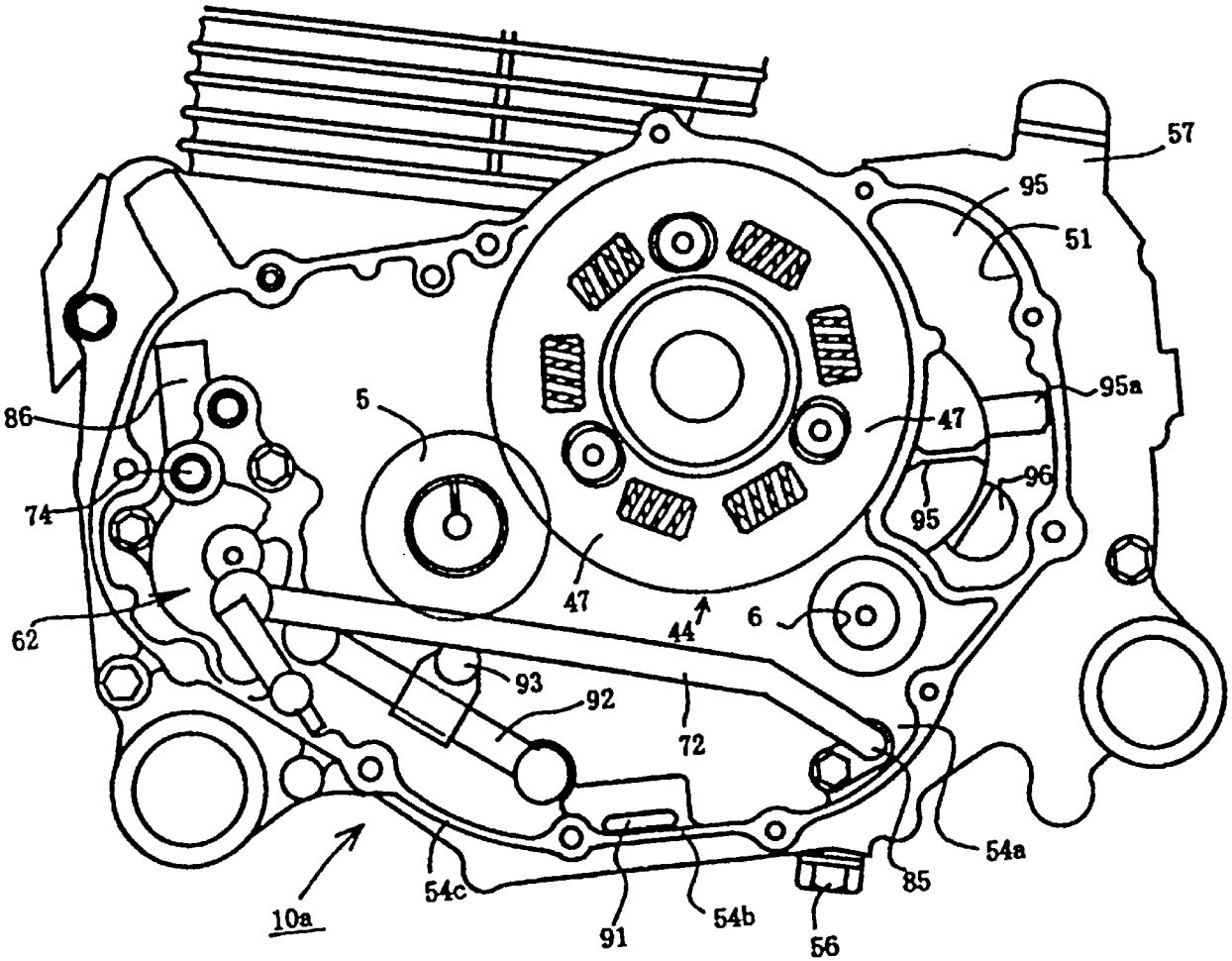
FIG. 8 is a front view of the front case of the crankcase, with a starting clutch removed.
Figure 9:
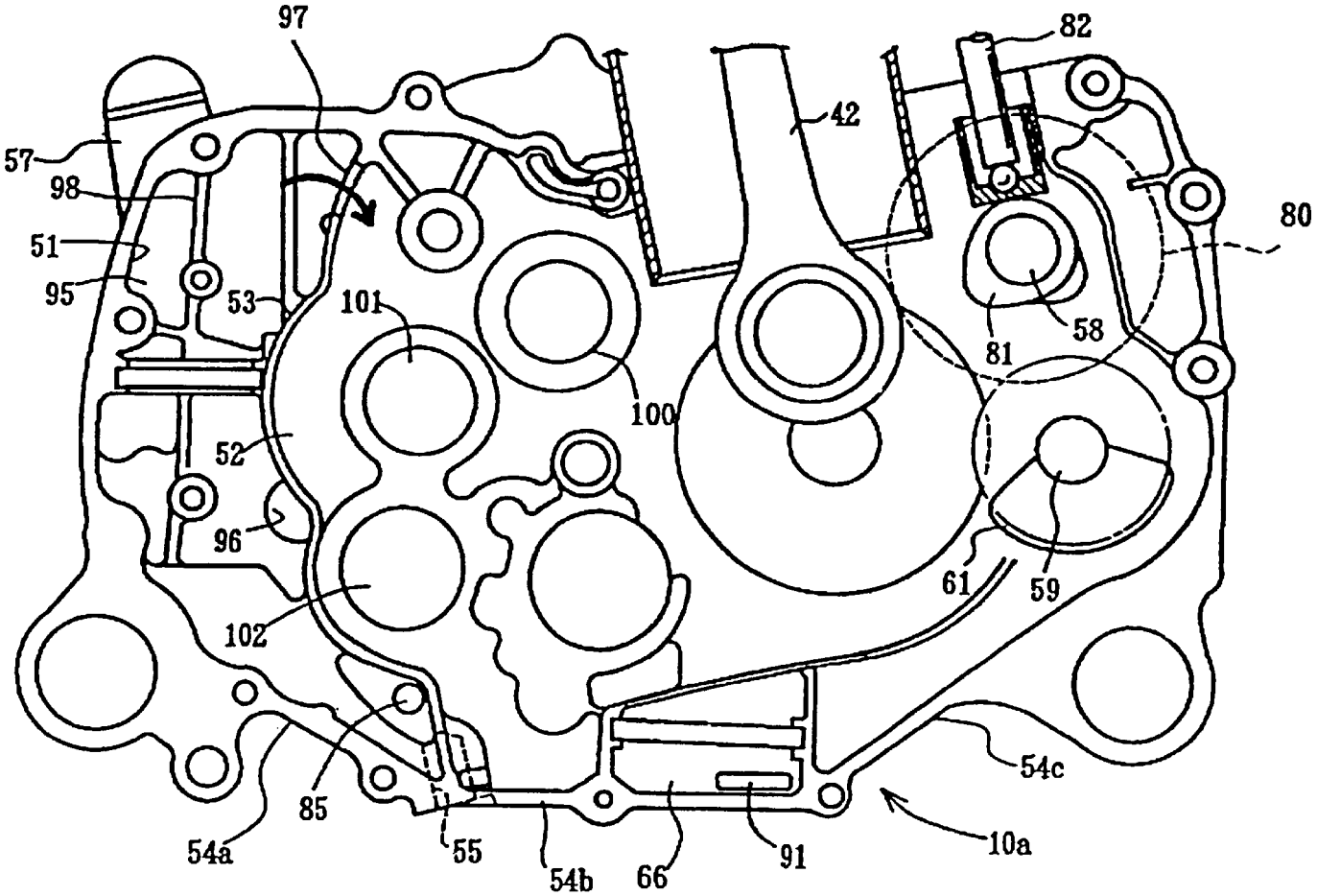
FIG. 9 is a rear view of the front case illustrating a joining surface of the front case for mating to a rear case.

FIG. 6 shows the front case cover 11 from the front. FIG. 7 shows the front case 10*a* from the front with part of the front case cover 11 cut away. FIG. 8 shows a front cover attaching surface of the front case 10*a* with the starting clutch 40 removed. FIG. 9 shows a surface of the front case 10*a,* to which the rear case 10*b* would be attached.

In FIGS. 6–9, the bottom section 54 of the front case 10*a* has a shape becoming narrower towards the bottom. The feed pump 63 of the oil pump 62 draws up oil from an inlet 85 (FIG. 9) provided at a lower end of the oil tank 51 via the feed pump pipe 72. The inlet 85 is formed at a lower end of the oil tank 51 wrapping around to the bottom of the output shaft 6 (FIG. 8). The feed pump pipe 72 runs over the starting clutch 40 and leads to a rear side of the starting clutch 40, and is piped to below the crankshaft 5 and the centrifugal clutch 47.

The feed pump 63 discharges oil from a discharge passageway 86 (FIG. 8) to the oil filter 65 (FIG. 7). The discharge outlet 87 of the oil filter 65 communicates with an oilway 88 facing towards the center of the crankshaft 5 formed in the front case cover 11. A filter housing 84 is provided in an upper shoulder of the front case cover 11. The oilway 88 is connected at the same time to an oilway 89 formed running through the center of the crankshaft 5 and to an oilway 90 formed running upwards above the front case cover 11. The oilway 90 supplies oil to parts other than the crankshaft 5, such as a valve mechanism and the transmission 44.

The scavenge pump 64 draws up oil from an inlet 91 through a scavenge pump pipe 92, using an oil sump 66 provided in the center section 54*b*. The scavenge pump pipe 92 runs diagonally along the direction of the sloping surface 54*c,* and has a middle section which is fastened to the front case 10*a* by a clip 93.

As shown in FIG. 6, an oil outlet 76 from the scavenge pump 64 is provided at a central section in the vertical direction of a front left end of the front case cover 11, at a position overlapping the oil pump 62. A return port 94, in communication with the return side hose 22 (FIG. 2) from the oil cooler 20, is provided in the right upper section of the front case, at a position overlapping the oil tank 51. Oil, returned from the oil cooler 20, enters the return port 94 and passes into sections of the oil tank 51 between the front case cover 11 and the front case 10*a*.

As shown in FIG. 7, a dividing or partition wall 95 is provided in the oil tank 51 for partitioning the inside of the oil tank 51 into a portion on the front case 10*a* side and a portion on the rear case 10*b* side. The partition wall 95 is provided with a rib 95*a,* and a communicating hole 96 communicated to the rear case 10*b* side. The communicating hole 96 is provided in the lower portion of the partition wall 95 at a position slightly elevated relative to the output shaft 6.

Oil entering between the front case cover 11 and the front case 10*a* flows through the communicating hole 96 to the oil tank 51 formed between the front case 10*a* and the rear case 10*b*. During the flow of oil to the oil tank 51, gas-liquid separation for the oil is promoted.

As shown in FIG. 9, a slot 97 is provided in an upper part of the bulkhead 53, and communication is established between the oil tank 51 and the transmission chamber 52. The height of the slot 97 is substantially the same as the height of the oil inlet 57. The slot 97 acts as an overflow to the inside of the transmission chamber, if supply to the oil tank 51 fills up. A number of ribs 98 are formed in the surface of the partition wall 95 on the rear case 10*b* side. FIG. 9 also illustrates a bearing hole 100 for the main shaft, a bearing hole 101 for the counter shaft, and a bearing hole 102 for the output shaft.

Figure 10:
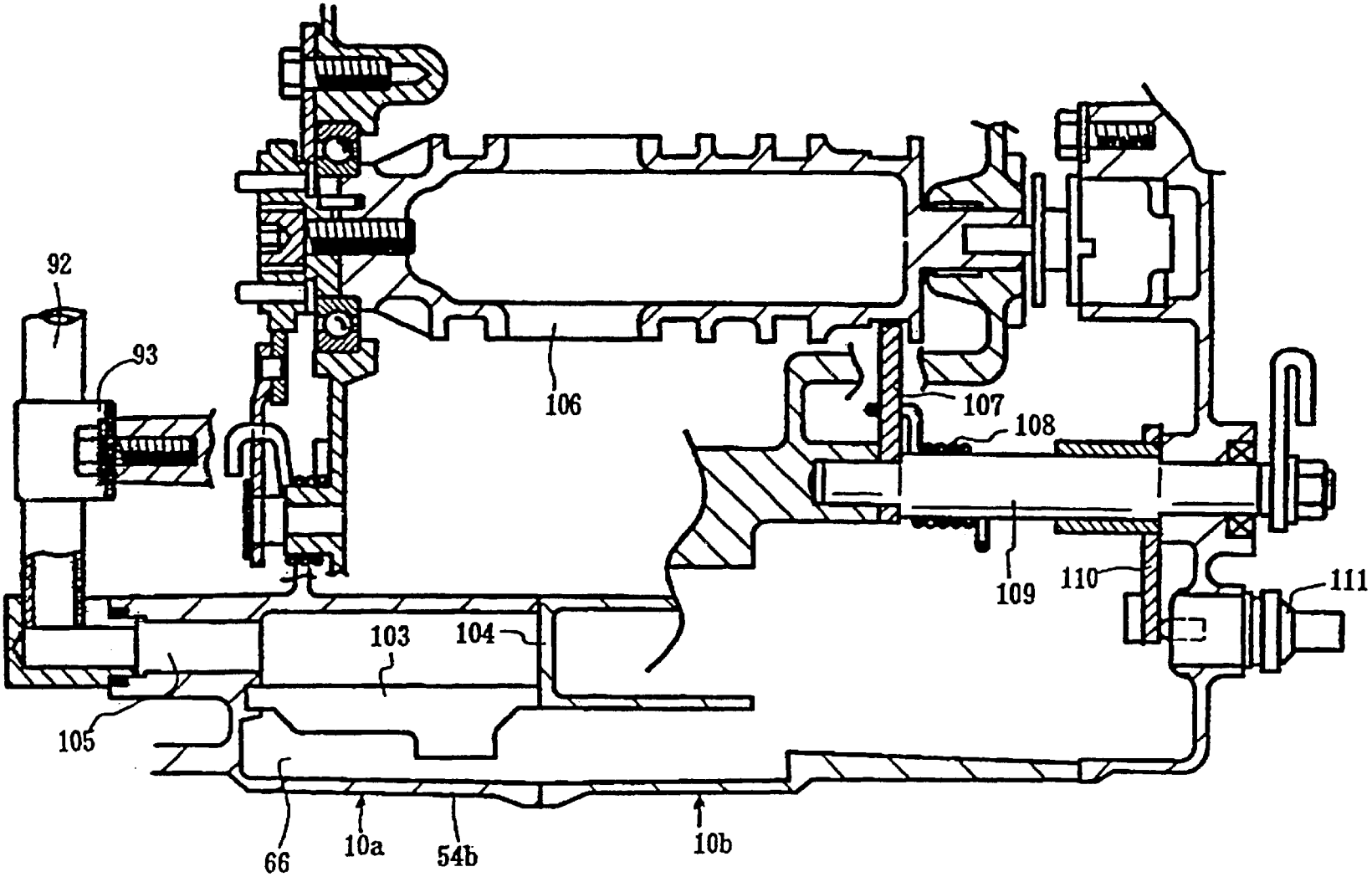
FIG. 10 is a cross sectional view taken in a longitudinal direction of the crankcase illustrating an oil sump pump of the oil pump.

FIG. 10 illustrates the structure of the oil sump 66. The oil sump 66 is formed in a section located at the juncture of the front case 10*a* and the central section 54*b* of the rear case 10*b*. A strainer 103 is contained in this space, with a rear portion of the strainer 103 supported by a wall section 104 of the rear case 10*b*. A scavenge pump inlet passageway 105 communicates with the oil sump 66 in the front case 10*a*. A lower end of the scavenge pump pipe 92 is connected to a tip opening section of the inlet passageway 105. FIG. 10 also illustrates a shift drum 106, a stopper arm 107, a return spring 108, a reverse switching shaft 109, a stopper sensor arm 110, and a stopper position detection switch 111.

Next, operation of the present invention will be described. Oil, after lubrication, drops down to the bottom 54 of the crankcase 10. Since the left and right of the crankcase 10 becomes narrower toward the bottom section 54, the oil easily accumulates in the oil sump 66 of the central section 54*b,* which is the lowest part of the crankcase 10. Oil accumulating in the oil sump 66 is drawn into the scavenge pump 64 housed inside the oil pump 62 via the scavenge pump pipe 92. This oil is sent through a discharge outlet 74, through a discharge outlet 75, formed in the front case cover 11, and through an outlet 76 to the sending side hose 21. The sending side hose 21 sends the oil to the oil cooler 20. Oil that has been cooled in the oil cooler 20 is returned to an upper section of the oil tank 51, via the return side hose 22 and the return outlet 94.

In this way, since the oil pump 62 and the oil tank 51 are provided on the left and right sides of the crankcase 10, the outlet 76 and the return port 94 can be provided in the left and right surfaces of the upper portion of the front case cover 11 covering the front case 10*a*. Accordingly, the outlet 76 and the return port 94 can be separately connected nearly in straight lines to the inlet and outlet provided in the left and right surfaces of the oil cooler 20 using the feed side hose 21 and the return side hose 22. As a result, the feed side hose 21 and the return side hose 22 can be made relatively short, and the piping layout can be simplified. This results in a reduction both in weight and cost, and also simplifies the assembly and maintenance procedures.

Furthermore, since the oil tank 51 and the oil pump 62 are arranged on the left and right sides of the crankshaft 5, the left side (the side on which the oil tank 51 is provided) of the oil cooler 20 facing to the front case cover 11 may be taken as the outlet and connected to the return side hose 22. The right side (the side on which the oil pump 62 is provided) of the oil cooler 20 may be taken as the inlet and connected to the feed side hose 21. With this arrangement, the feed side hose 21 and the return side hose 22 can be separated from each other and can be laid out in nearly straight lines. As a result, feed side hose 21 and the return side hose 22 can be made relatively short and the piping layout is simplified.

Since the oil tank 51 is elongated in the vertical direction and has a substantially crescent shape, and also since the crankcase 10 becomes narrower towards the bottom, oil is efficiently sent in to the inlet 85 at the lowest point, the capacity of the oil tank 51 can be made as large as a half or more of the total capacity of the crankcase 10, and the variation of the oil level is thus reduced. Since the oil tank 51 is provided in the crank case 10, the center of gravity is lowered and the weight of the parts is more concentrated, so that a change in the center of gravity due to variations in the oil level is reduced.

According to the present invention, the oil recovery rate or ratio is high and there is no need to use a special oil pump because the scavenge pump 64 draws up oil from the oil sump 66, which is located in the lowest part of the crankcase 10 wherein the crankcase becomes narrower towards the bottom. As a result, no special oil pan is required. Thus, ground clearance is increased, the overall height of the engine is reduced, and the oil passageways are shortened. Shortening the oil passageways shortens the time required to supply oil to portions of the engine to the lubricated.

According to the present invention, oil is returned from the oil cooler 20 to the return inlet 94 of the front case cover 11 provided on an upper part of the oil tank 51. The oil exiting from the return inlet 94 collides with the partition wall 95 of the oil tank 51. The oil then drops down downwardly and comes into contact with a number of the plurality of ribs 95*a*. This path of the oil exiting from the return inlet 94 causes air entrapped in the oil to be easily separated from the oil, thus facilitating gas-liquid separation of air within the oil. Moreover, movement of the oil through the communication hole 96 inside the oil tank 51 also promotes gas-liquid separation.

The plurality of ribs 95*a* and 98 not only serve to promote air-oil separation, the ribs 95*a* and 98 also act as structural reinforcement members. By reinforcing the walls of the oil tank 51, resonance due to vibration of the walls of the oil tank 51 is reduced or prevented.

Due to the slot 97, provided on an upper part of the bulkhead 53, excess oil in the oil tank 51 overflows from the slot 97 to the transmission chamber 52. If the width of the slot 97 is set so that the slot 97 covers the overall width of the gear train, the meshing sections and sliding sections of the gear train immediately below the slot 97, as well as sliding grooves of a shift drum, are lubricated. Because the oil tank 51 is usually filled, the feed pump 63 stably supplies oil to necessary lubrication locations.

The oil inlet 57 is provided just above the oil tank 51. When oil is added, excess oil overflows into the transmission chamber 52 through the cutout 97. As a result, it is easy to maintain an oil level inside the oil tank 51 at a specified level at all times. The present invention does not have an independent oil tank. However, by providing the overflow slot 97, it is possible to ensure the oil level using the same procedure as in a normal wet sump structure.

Since the bottom 54 and the bulkhead 53 are punched out so that the drain hole 55 communicates with both the oil tank 51 and the transmission chamber 52, a single drain hole 55 can be commonly used. Therefore, the number of manufacturing steps is minimized and only a single drain bolt 56 is used, thus reducing the number of parts. When the oil is changed, used oil is taken out from the drain hole 55 and new oil is put in through the inlet 57. The oil level is checked and confirmed using a level gauge.

Still further, a cam sprocket 80 of the cam shaft 58 and the oil pump 62 are respectively separately arranged behind and in front of the balance shaft 59. As a result, there is no danger of the oil pump 62 interfering with a cam chain 60 for driving the cam sprocket 80. Therefore, it is possible to increase the size of the oil pump 62 without increasing the size of the crankcase 10.

Further, oil pipe clips are arranged inside the starting clutch 40, and the cam chain 60 is arranged between a balancer gear 78 and the ACG 41, which means that a space for housing the oil tank 51 can be maintained more to the outside than these internal components. In this way, it is possible to design a more compact engine by more efficient use of space and to have more flexibility in arranging auxiliary devices and in planning the engine structure. Further, since there is no need to provide an independent oil tank, the advantages of a conventional dry sump structure are maintained, while also enjoying the advantages of simplifying the lubrication system.

This above described arrangement structure of the oil tank, transmission and auxiliary devices can also be used in engines other than engines for use with an ATV, and with engines which do not have an output shaft. When no output shaft is employed, the space of the output shaft may be assigned to the oil tank. As a result, an overall height of the right side may be reduced lower than the crank shaft, and it is possible to further slope the cylinder block to the right side using that empty space. As a result, it is possible to provide an engine having a low center of gravity with a reduced overall height. Also, it is possible to vertically divide connecting sections of the piping for the oil pump 62 and the oil tank 51, so that the scavenge pump 64 and the upper part of the oil tank 51 are connected, and the feed pump 63 and the lower part of the oil tank 51 are connected.

According to the present invention, a lubrication system for an internal combustion engine includes a lubrication device, comprising the feed pump for supplying lubricating oil inside the oil tank to respective lubrication systems of the internal combustion engine, and the scavenge pump for returning lubricating oil that has accumulated in the crankcase bottom of the internal combustion engine to the oil tank. The oil pump is arranged on one side of the crankcase and the oil tank is arranged on the other side of the crankcase. Discharged oil from the scavenge pump is sent to an oil cooler. Returning oil from the oil cooler is returned to the oil tank. Oil in the oil tank is supplied by the feed pump to parts of the engine.

By arranging the oil tank on one of either the left or right sides of the crankcase and the oil pump on the other side, it is possible to connect oil hoses having a minimum length from the oil tank and the oil pump, respectively, to an oil cooler. There is no need for the piping to intersect, be gathered together at one side, or to be curved over a cylinder. Further, it is possible to adjustably shorten the oil hoses. As a result, it is possible to reduce the weight and costs of the engine. Moreover, the assembly and maintenance are simplified.

When the engine is mounted transversely with the crankshaft parallel to the direction of travel of the vehicle, the oil tank and the oil pump are located on either side of the vehicle, i.e., on either side of the crankshaft. An inlet and an outlet normally provided on the left and right sides of the power unit can be directly connected to a sending side outlet and a return side inlet on the sides of the power unit. The oil cooler is arranged on the front of the power unit with cooling surfaces facing in the direction of travel. By this arrangement, piping can be made extremely smooth and simple.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An internal combustion engine comprising:

a crankcase;

an oil tank arranged inside and on one side of said crankcase; and an oil pump arranged inside and on another side of said crankcase opposite to said one side of said crankcase, said oil pump including a feed pump and a scavenge pump, said feed pump for supplying lubricating oil inside said oil tank to respective components of the internal combustion engine, and said scavenge pump for returning lubricating oil that has accumulated in a bottom of said crankcase to said oil tank.

2. The engine according to claim 1, further comprising:

an oil cooler, wherein oil pumped by said scavenge pump is passed through said oil cooler prior to being returned to said oil tank.

3. The engine according to claim 1, further comprising:

a crank shaft disposed in said crankcase, said crankshaft being disposed between said oil tank and said oil pump.

4. The engine according to claim 1, wherein an outer wall of said crankcase is also an outer wall of said oil tank.

5. The engine according to claim 1, wherein said feed pump includes a feed pump rotor and said scavenge pump includes a scavenge pump rotor, which is coaxial with said feed pump rotor.

6. The engine according to claim 1, further comprising:

an oil passageway connecting said scavenge pump to a bottom portion of said crankcase.

7. The engine according to claim 1, further comprising:

a partitioning wall extending from an upper wall of said crankcase to a lower wall of said crankcase, wherein said oil tank is formed between said partitioning wall and an outer side wall of said crankcase.

8. An internal combustion engine comprising:

a crankcase;

a crankshaft disposed in said crankcase;

an oil tank arranged inside said crankcase and on one side of said crankshaft;

an oil pump arranged inside said crankcase and on another side of said crankshaft opposite to said one side of said crankshaft, said oil pump including a feed pump and a scavenge pump, said feed pump for supplying lubricating oil inside said oil tank to respective components of the internal combustion engine, and said scavenge pump for returning lubricating oil that has accumulated in a bottom of said crankcase to said oil tank; and an oil cooler, wherein oil pumped by said scavenge pump is passed through said oil cooler prior to being returned to said oil tank.

9. The engine according to claim 8, wherein said feed pump includes a feed pump rotor and said scavenge pump includes a scavenge pump rotor, which is coaxial with said feed pump rotor.

10. The engine according to claim 8, further comprising:

oil passageway connecting said scavenge pump to a bottom portion of said crankcase.

11. The engine according to claim 8, further comprising:

a partitioning wall extending from an upper wall of said crankcase to a lower wall of said crankcase, wherein said oil tank is formed between said partitioning wall and an outer side wall of said crankcase.

12. A combination comprising:

a vehicle; and an internal combustion engine including:

a crankcase;

a crankshaft disposed in said crankcase, with said crankshaft extending in a direction parallel to a direction of travel of said vehicle;

an oil tank arranged inside said crankcase and on one side of said crankshaft;

an oil pump arranged inside said crankcase and on another side of said crankshaft opposite to said one side of said crankshaft, said oil pump including a feed pump and a scavenge pump, said feed pump for supplying lubricating oil inside said oil tank to respective components of the internal combustion engine, and said scavenge pump for returning lubricating oil that has accumulated in a bottom of said crankcase to said oil tank; and an oil cooler, wherein oil pumped by said scavenge pump is passed through said oil cooler prior to being returned to said oil tank.

13. The combination according to claim 12, wherein said oil cooler includes a cooling surface facing toward the direction of travel of said vehicle.

14. The combination according to claim 12, wherein an outer wall of said crankcase is also an outer wall of said oil tank.

15. The combination according to claim 12, wherein said feed pump includes a feed pump rotor and said scavenge pump includes a scavenge pump rotor, which is coaxial with said feed pump rotor.

16. The combination according to claim 12, further comprising:

an oil passageway connecting said scavenge pump to a bottom portion of said crankcase.

17. The combination according to claim 12, further comprising:

a partitioning wall extending from an upper wall of said crankcase to a lower wall of said crankcase, wherein said oil tank is formed between said partitioning wall and an outer side wall of said crankcase.

18. The combination according to claim 12, wherein said vehicle is an ATV.

* * * * *